US006343729B1

(12) United States Patent
Platta

(10) Patent No.: US 6,343,729 B1
(45) Date of Patent: Feb. 5, 2002

(54) DISPOSABLE BACKPACK

(75) Inventor: Victor A. Platta, Mandeville, LA (US)

(73) Assignee: Advance Polybag, Inc, Metairie, LA (US)

( * ) Notice: Subject to any disclaimer, the term of this patent is extended or adjusted under 35 U.S.C. 154(b) by 0 days.

(21) Appl. No.: 09/648,580

(22) Filed: Aug. 25, 2000

Related U.S. Application Data

(63) Continuation-in-part of application No. 09/387,154, filed on Aug. 31, 1999, now abandoned.

(51) Int. Cl.[7] ..... A45F 3/04

(52) U.S. Cl. ..... 224/627; 224/153; 383/8; 493/226

(58) Field of Search ..... 224/153, 627, 224/645, 602; 383/8, 16; 190/103; 493/226

(56) References Cited

U.S. PATENT DOCUMENTS

| | | | | | |
|---|---|---|---|---|---|
| 37,936 | A | * | 3/1863 | Clark | |
| 4,153,092 | A | * | 5/1979 | Haslam | 224/153 |
| 4,911,560 | A | * | 3/1990 | Hoover et al. | 383/8 |
| 5,211,716 | A | * | 5/1993 | Tobias | |
| 5,255,833 | A | * | 10/1993 | McAllister | 224/602 |
| 5,570,828 | A | * | 11/1996 | Lewis | 224/627 |
| 5,738,263 | A | * | 4/1998 | Lewis | 224/627 |

FOREIGN PATENT DOCUMENTS

| | | | | |
|---|---|---|---|---|
| DE | 2613415 | * | 11/1989 | 224/209 |
| DE | 3829056 | * | 11/1989 | 383/8 |
| EP | 260229 | * | 3/1988 | 224/213 |

* cited by examiner

*Primary Examiner*—Gregory M. Vidovich
(74) *Attorney, Agent, or Firm*—Joseph T Regard plc

(57) ABSTRACT

A disposable backpack which is formed of thin film plastic material or the like, so as to provide a bag-like container for carrying goods or the like in the form of a backpack. The present invention provides a relatively cheap, disposable, and strong temporary backpack which is comfortable to use and easily stored in quantity, so as to be dispensed as a bag. Further, the present invention is configured to be carried as a traditional t-shirt sack, or worn as a backpack, depending upon the distance traveled and wishes of the user. The present invention may be sold individually, or may be provided for no charge by a vendor as a type of bag for carrying purchased contents. The preferred embodiment of the present invention contemplates a disposable backpack formed of HDPE or co-extruded HDPE/LLDPE having front and back, gusseted or non-gusseted walls, a bottom, and an open bag mouth portion which may be closed via flap or other configuration. Emanating from opposing side edges of the back wall are first and second straps configured to engage the shoulders of the user, such that at least a portion of the back wall rests against the back of the user. The shoulder straps may be formed of folded thin film plastic straps, and may be affixed in generally parallel fashion at their respective ends to the back wall of the bag.

3 Claims, 12 Drawing Sheets

13
9

5
5
11
11'
10
14
8'
12
16
6
6
15
9'
16
14
18
19
91
9 a. extruding a tube of thin film plastic having a length b. flattening said tube c. forming in said length of tube a thermoplastic bag having front and rear walls having upper and lower ends, said lower ends sealed to one another such that front and rear walls form a body configured to carry goods between said front and rear walls, said bag further having first and second edges and upper and lower ends, a bag mouth having first and second opposing ends, and a medial area therebetween, said first and second straps emanating from said first and second opposing ends of said bag mouth, respectively, each of said straps having a free end distal said bag mouth d. securing said free end of each of said first and second to said rear of said bag wall so as to form a backpack.

FIGURE 15

DISPOSABLE BACKPACK

STATEMENT OF CONTINUING APPLICATIONS

The present application is a continuation-in-part of U.S. Patent application Ser. No. 09/387,154, filed Aug. 31, 1999 now abandoned, listing Victor A. Platta as the inventor.

TECHNICAL FIELD OF THE INVENTION

The present invention relates to packs worn by upon the back and carried over the shoulders, and in particular to a disposable backpack which is formed of thin film plastic material or the like, so as to provide a bag-like container for carrying goods or the like in the form of a backpack.

The present invention provides a relatively cheap, disposable, and strong temporary backpack which is comfortable to use and easily stored in quantity, so as to be dispensed as a bag. Further, the present invention is configured to be carried as a traditional t-shirt sack, or worn as a backpack, depending upon the distance traveled and wishes of the user.

The present invention may be sold individually, or may be provided for no charge by a vendor as a type of bag for carrying purchased contents, which may include consumer items, food, or the like, thus making the present invention particularly useful for use at festivals, events, or the like where the user needs to carry the contents for an extended distance or period of time.

The preferred embodiment of the present invention contemplates a disposable backpack formed of HDPE, co-extruded HDPE/LLDPE, or other material having front and back, gusseted or non-gusseted walls, a bottom, and an open bag mouth portion which may be closed via flap or other configuration. Situated at opposing side edges of the back wall are first and second straps configured to engage the shoulders of the user, such that at least a portion of the back wall rests against the back of the user. The shoulder straps may be formed of folded thin film plastic straps, and may be affixed in generally parallel fashion at their respective ends to the back wall of the bag. Alternative designs are also contemplated wherein the straps are situated at different positions, as well as alternative bag wall layout schemes are taught.

BACKGROUND OF THE INVENTION

Backpacks of various configurations have been utilized for centuries by soldiers, campers, and travelers, having been fabricated of canvas, leather, and more recently, ballistic nylon and the like. While the prior art backpacks are often useful and durable, these can be disadvantages in circumstances requiring a lightweight, inexpensive, and short-lived unit for carrying an item just purchased a distance, comprising a load which is too heavy or uncomfortable to convey using a traditional paper or plastic bag.

In the U.S., it is thermoplastic "t-shirt" bags are the most prevalent bag used today, comprising a bag having a body with a bag mouth, and first and second handles emanating from opposing sides of the bag mouth. While these bags are inexpensive, relatively strong, lightweight and effective for carrying heavy loads a short to moderate distance, these bags do require the user to hold them with the users hands, and can be uncomfortable to hold for moderate to longer distances.

Thus, there exists a need for an inexpensive, lightweight, strong, and disposable system for conveying goods or the like a moderate to long distance in a relatively comfortable, non-debilitating fashion.

A list of patents which may have some pertinence to the present invention include:

| U.S. Pat. No. | Inventor | Date of Issue |
|---|---|---|
| Des 402,460 | Moor | 12/15/1998 |
| 5,863,130 | Nguyen | 01/26/1999 |
| 5,377,887 | Garcia | 01/03/1995 |
| 4,856,570 | Rushing et al | 08/15/1989 |
| 4,655,343 | Lane et al | 04/07/1987 |
| 4,384,602 | Ores | 05/24/1983 |
| 4,273,274 | Freistadt | 06/16/1981 |
| 4,153,092 | Haslam | 05/08/1979 |
| 3,802,613 | Droeger | 04/09/1974 |

U.S. Pat. No. D 402,460 illustrates a typical backpack or book bag configuration, wherein there is provided a body having a zippered flap for storing contents therein, and first and second straps having first and second ends, the first ends affixed to the lower rear wall of the body, the second ends affixed to the upper rear wall of the body, the straps in spaced, parallel relationship to ride the shoulders of the user.

U.S. Pat. No. 5,863,130 issued 1999 to Nguyen illustrates (FIG. 8 and FIG. 2D) a bag having a body having a bag mouth for placing contents therein, the bag mouth having emanating therefrom first and second handles.

While both of the above designs are useful in there own right, there is not believed to be any single prior art device which can provide the benefits of both in a single apparatus.

GENERAL SUMMARY DISCUSSION OF THE INVENTION

The present invention contemplates a disposable backpack which is inexpensive, strong, lightweight, comfortable to wear, and which provides the benefits found in the prior art t-shirt bags and backpacks, in a single apparatus.

Unlike the prior art, which contemplated either a thin plastic bag which had handles designed to be grasped by the hand, or backpacks which were expensive for manufacture and only useable as a backpack, the present invention contemplates an inexpensive, strong, and flexible package carrying system whereby a user may comfortably convey the contents therein by carrying it as a bag, or wearing the invention as a backpack, depending upon the individual taste of the user, and circumstances of use. For example at a festival or event, a user may be required to spend a whole day carrying purchases which may include souvenirs, food, beverages, etc. This knowledge alone may influence a user from not purchasing items, or limiting purchases to immediately consumed, or smaller, easily carried items. The present invention is designed to provide to the vendor an inexpensive means of providing the consumer an alternative to uncomfortably carrying the purchased items—the consumer may now comfortably convey the purchased items, for all day if necessary, while keeping the consumers hands free, thus perhaps influencing the consumer to purchase more from the vendor.

Also, the present invention provides to the consumer an inexpensive, easily carried "day pack", which may be carried in the users pocket until required; further, because the present invention is light weight and strong, the present invention may be utilized by tri-athletes and the like, to provide an inexpensive, disposable means of carrying food, equipment, or liquids for use by the athlete in the course of the event. The present invention can be formed of plastics which may include photo-degradable or bio-degradable additives, providing an environmentally sound disposable item.

As indicated, the present invention provides a relatively cheap, disposable, and strong temporary backpack which is comfortable to use and easily stored in quantity, so as to be dispensed as a bag, but worn as a backpack, as desired.

The preferred embodiment of the present invention contemplates a disposable backpack formed of HDPE or co-extruded HDPE/LLDPE having front and back, gusseted or non-gusseted walls, a bottom, and an open bag mouth portion which may be closed via flap or other configuration. A preferred embodiment of the present invention contemplates first and second straps situated at opposing side edges of the back wall, the straps configured to engage the shoulders of the user, such that at least a portion of the back wall rests comfortably against the back of the user. The shoulder straps may be formed of folded thin film plastic straps to provide a strong, non-binding support, and may be affixed in generally parallel fashion at their respective ends to the back wall of the bag. Alternative designs are also contemplated wherein the straps are situated at different positions, as well as alternative bag wall layout schemes are taught.

It is therefore an object of the present invention to provide a thin film container of flexible film which may be conveyed as a backpack or bag.

It is also an object of the present invention to provide a backpack which may be dispensed in quantity as a bag by a vendor for conveying purchased items by the purchaser in a comfortable, extended time fashion.

It is another object of the present invention to provide a backpack which is lightweight and low cost, requiring nominal storage space, making it an ideal alternative to traditional t-shirt sacks for vendors at festival, sporting events, or the like.

It is another object of the present invention to provide a backpack which may be utilized by an athlete during a sporting event to portably convey in an inexpensive and efficient manner, equipment, food, or fluids during an event such as a triathelon or the like.

It is another object of the present invention to provide a backpack which may be carried by a user in the user's conventional pants pocket until required, and disposed of once utilized, at nominal cost to the user.

Lastly, it is an object of the present invention to provide a method and system for conveying articles which provides the user with a comfortable, low-cost alternative to traditional bags or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 15 illustrates a method chart of forming a backpack according to the present invention.

DETAILED DISCUSSION OF THE INVENTION

Figure 2:
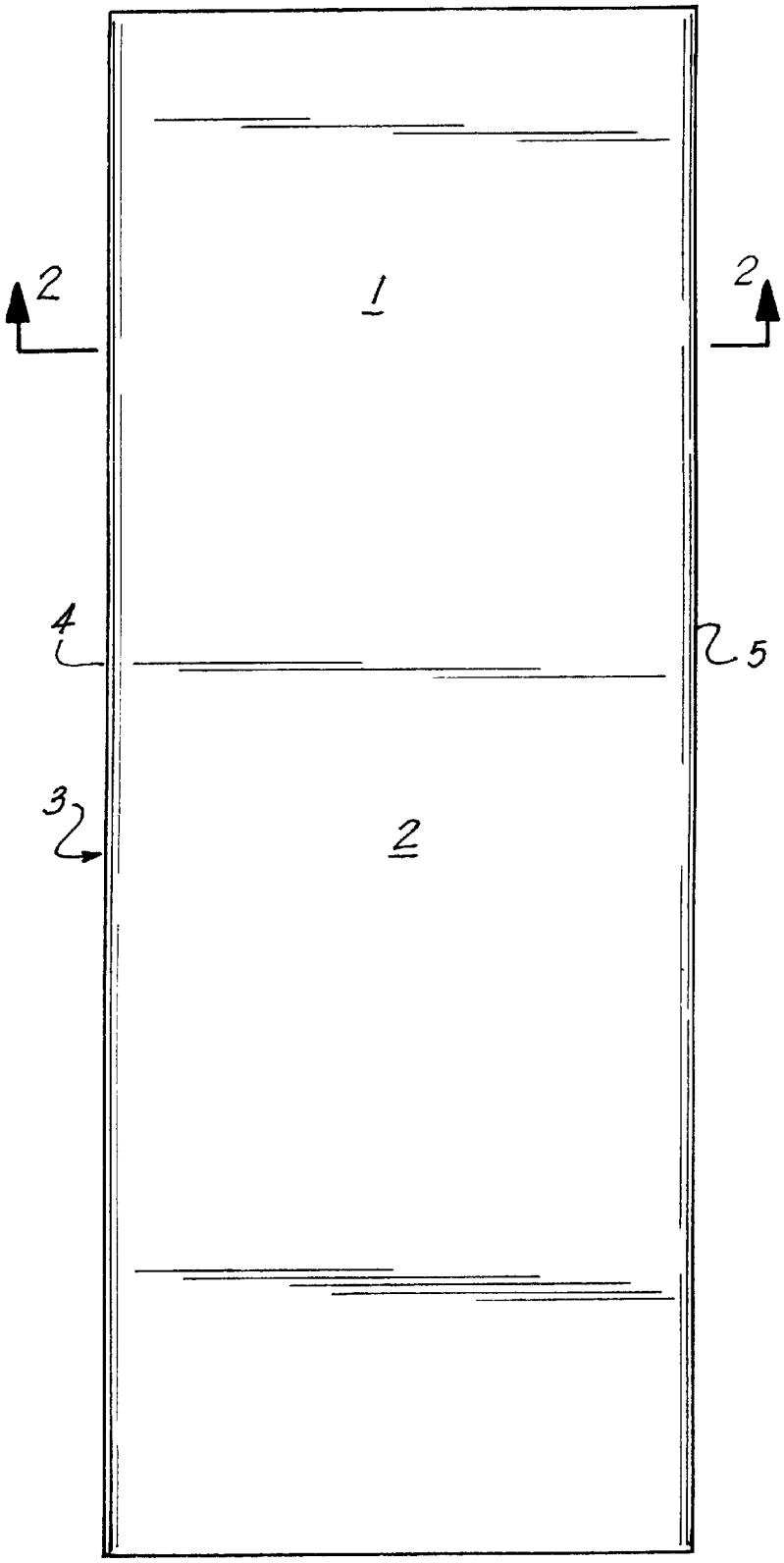
FIG. 2 is an end view of the exemplary thin film tube of FIG. 1.
Figure 3:
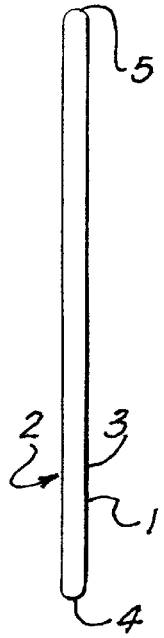
FIG. 3 is an end view of the thin film tube of FIG. 1, illustrating the folding of the edges of the tube to form gussets.
Figure 1:
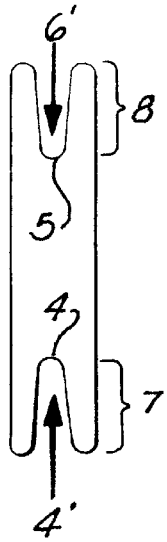
FIG. 1 is a front view of an exemplary thin film tube, for illustration of the method of making the present invention.
Figures 4, 5, 6, 7:
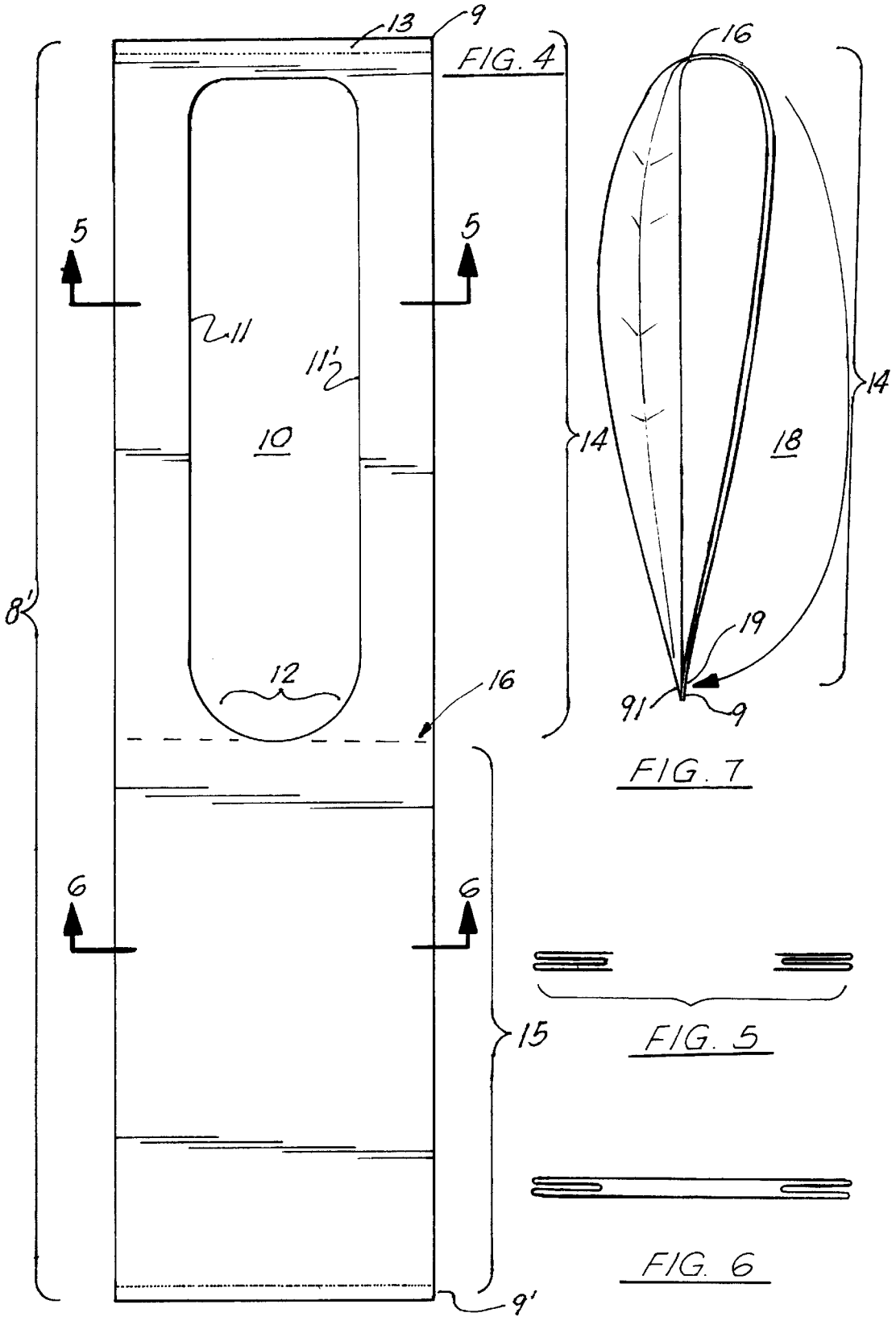
FIG. 4 is a top view of an exemplary cutout configuration of the thin film tube of FIG. 1, illustrating the body of the backpack, open bag mouth, a sealed bottom, and first and second straps having distal ends from the bag mouth.
FIG. 5 illustrates an end configuration of the invention of FIG. 4.
FIG. 6 illustrates an end configuration of the invention of FIG. 4
FIG. 7 illustrates the step of manufacture of the invention of FIG. 4, wherein the distal ends of the first and second straps are secured near the bottom of the back bag wall, in order to form the backpack.

Referring to FIG. 1 of the drawings, a flattened film tube 1 of high density polyethelyne (HDPE), low density polyethylene (LDPE), co-axially extruded HDPE/LDPE, linear low density polyethylene (LLDP) or the like is provided having a front face 2, a rear face 3, formed of first and second walls, respectively, and first 4 and second 5 edges. In the preferred embodiment of the invention, first 7 and second 8 gussets are formed by folding over and applying pressure 4', 6' to edges 4, 5 respectively.

Continuing with FIGS. 4–6, 12A, 12B, and 13A, 13B, a length 8' of the aforementioned tube is cut, and a handle cut 10 is formed, removing a portion of the front and rear faces of the tube, forming a bag having first 9 and second 9' ends, first 11 and second 11' straps, and a bag mouth 12 therebetween, the bag mouth configured to receive and convey goods in the body of the bag such as groceries, clothes, goods, etc. The respective ends 9, 9' are welded 13, 13', sealed, or otherwise adhered such that the respective layers of bag walls provided therein are joined.

Figure 12A:
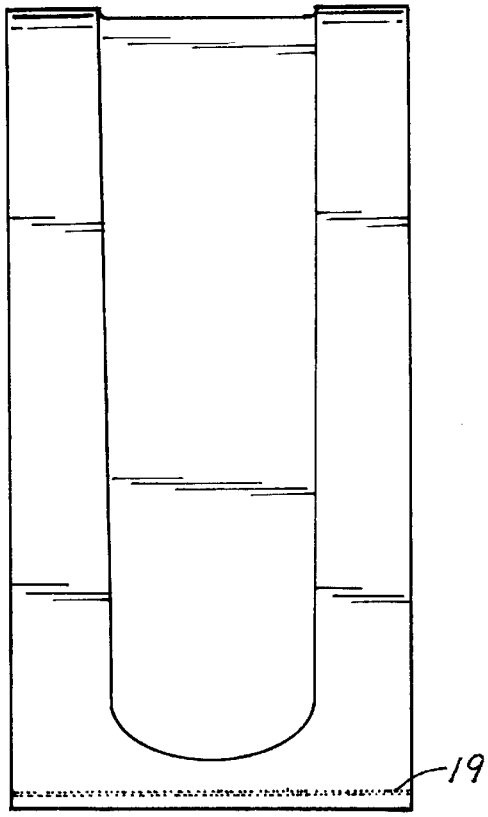
FIGS. 12A–12B illustrate back and side views of an alternative embodiment of the backpack of the present invention.
Figure 12B:
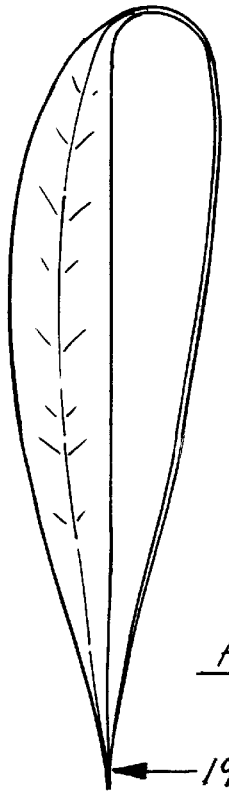
Figure 12C:
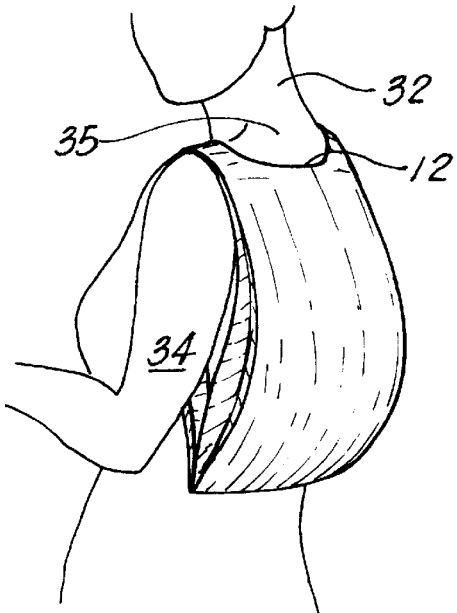
FIGS. 12C–12D illustrate isometric and front views of the embodiment of FIGS. 12A–12B, as worn by a user.
Figure 12D:
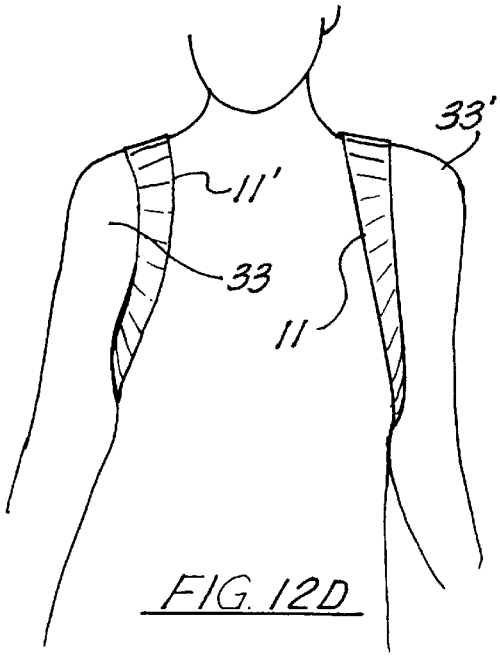
Figure 13A:
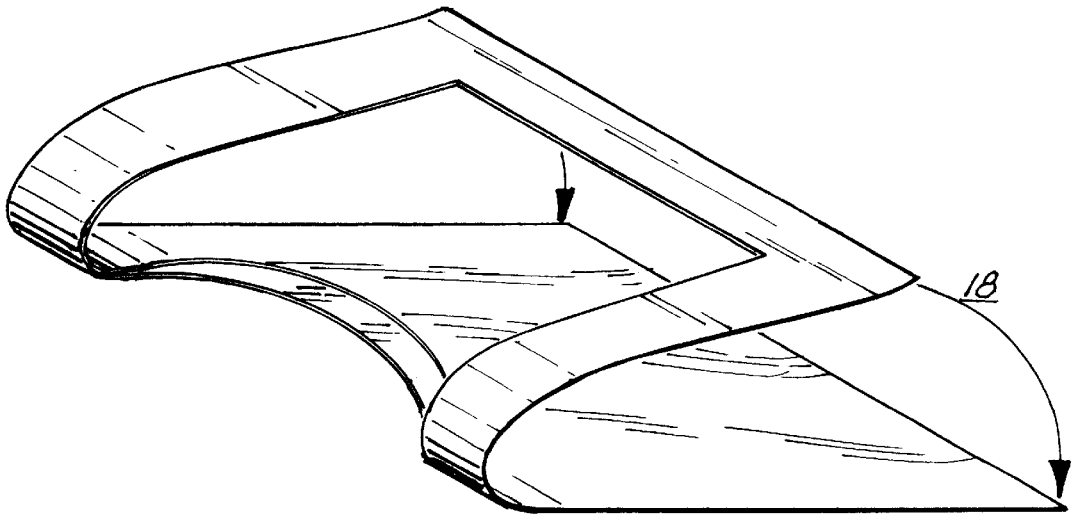
FIGS. 13A–13B illustrate the configuration of the shoulder straps of the invention of FIGS. 12A–12B, and the method of adhering same to the base of the rear bag wall.
Figure 13B:
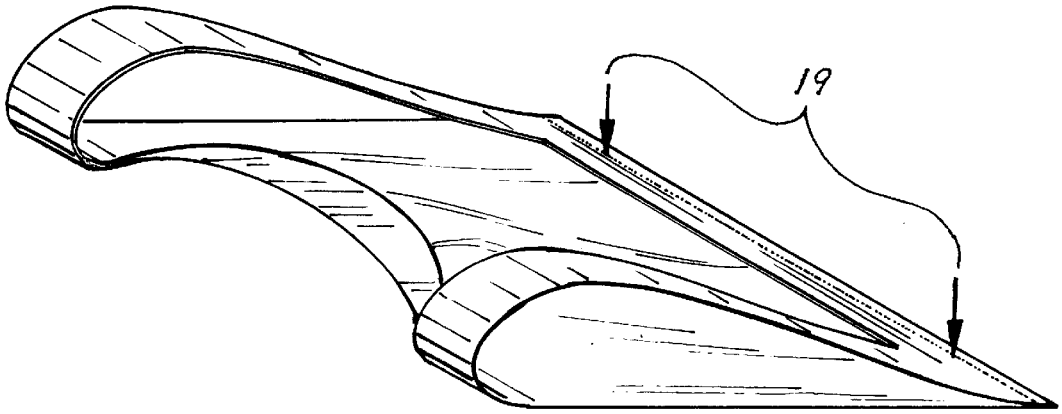

The unit is then laterally folded 18 at about the bag mouth 12, which in the present design is along a lateral line about medial 16 of the length of the unit, which about evenly divides the strap portion 14 from the main body 15 portion, such that the upper, first end 9 of the unit contacts one of the front or rear walls at about the lower, second end 9' of the unit, and sealed 19 as above, forming a backpack which may be worn by a user as shown in FIGS. 12C, 12D, wherein first 11 and second straps encircle the first 33' and second 33 shoulders of a user, and the straps are situated under the arms 34 of the user. The body of the unit then rests comfortably against the back of the user, with the backpack opening or mouth 12 resting adjacent to the base of the neck 35 of the user.

Figure 9:
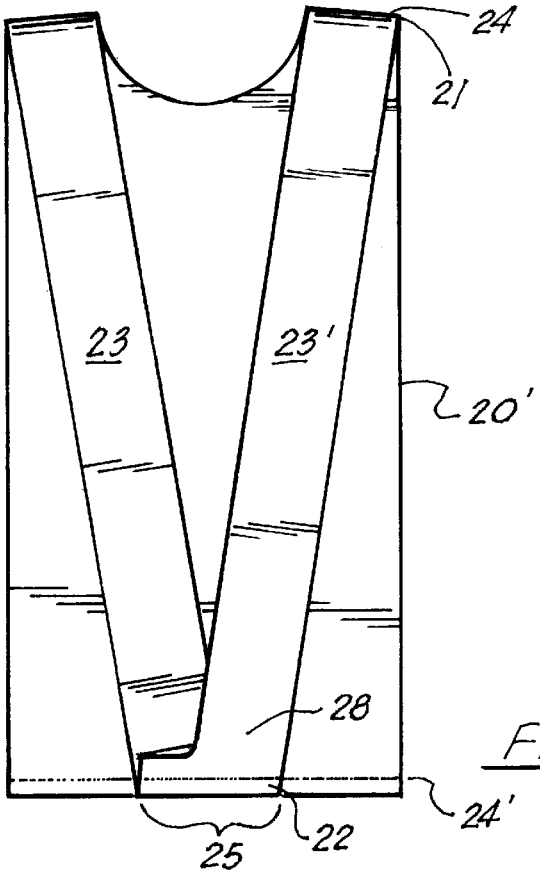
FIG. 9 illustrates a rear view of the alternative design of FIG. 8, showing the straps as folded and affixed to the lower back wall of the bag.
Figure 8:
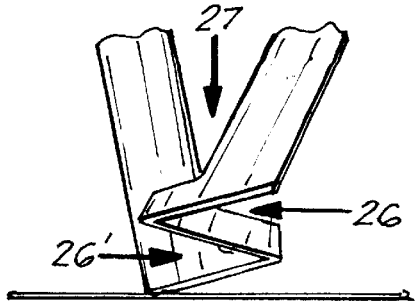
FIG. 8 illustrates an additional step to form an alternative design of the present invention of FIG. 4, wherein the distal ends of the first and second straps are brought together and joined in the vicinity of the bottom of the back bag wall in medial fashion.

Continuing with FIGS. 8 and 9, an alternative embodiment 20' of the present invention has first 24 and second 24' ends, with first 23 and second 23' straps having first 21 and second 22 ends, the first ends of said straps emanating from opposing sides of the bag mouth at the first ends 24 and 24', the second 22 ends of the one of the straps (illustrated is the second 23' strap) placed 26, 26' atop 27 the second end of the other strap (in this case, the first 23 strap) so that the second ends overlap, the overlapped second ends of the strap situated in a generally medial position 25 at the second end 24' of the bag, and welded 28, sealed, or otherwise adhered to the second end of the bag.

Figure 11:
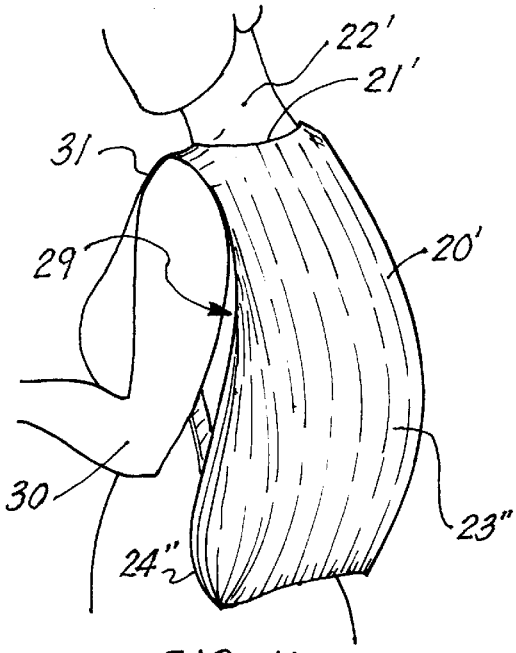
FIGS. 10–11 illustrate front and isometric views of the preferred embodiment of the present invention in use, worn by a user.
Figure 10:
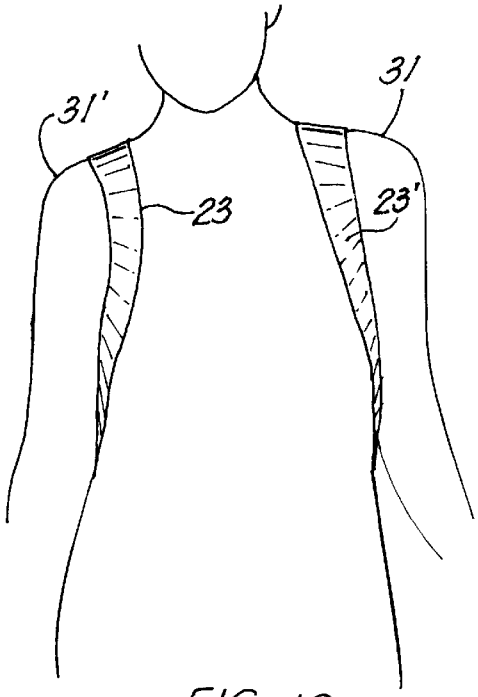
Figure 14C:
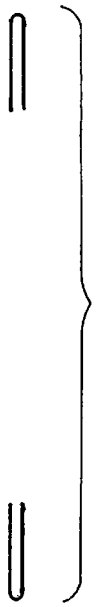
FIG. 14C illustrates cross-sectional view of the straps of the bag of FIG. 14A.
Figure 14B:
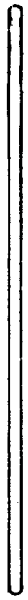
FIG. 14B illustrates a cross-sectional view of the body of the bag of FIG. 14A.
Figure 14A:
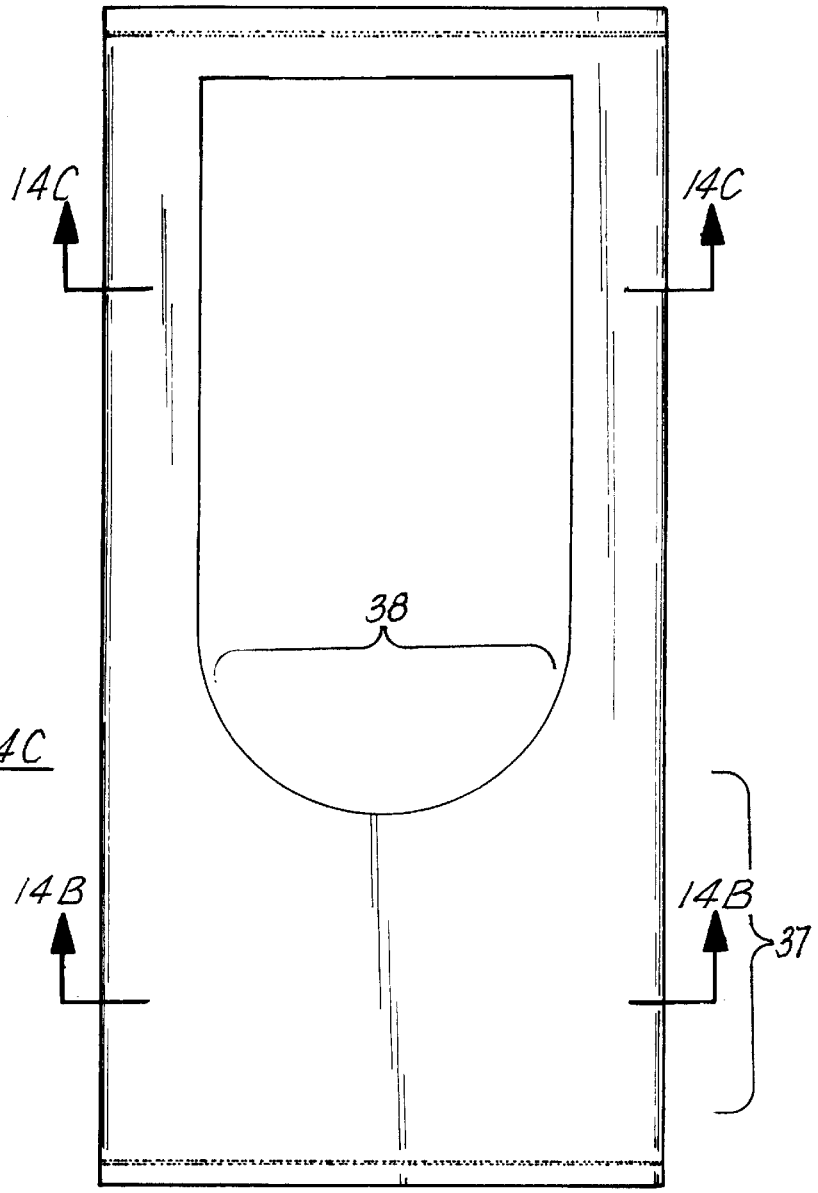
FIG. 14A illustrates a frontal view of a non-gusseted version of the bag of FIGS. 12A–12B laid flat.

FIGS. 10 and 11 illustrate position of the alternative embodiment of FIGS. 9 and 10 upon a user. As shown in FIGS. 10, 11, the second embodiment 20' of the invention is worn as a conventional backpack, with the rear wall 24" resting against the back 29 of the user, with first mouth 21' of the bag adjacent to the lower neck 22' of the user, with the front wall 23" situated away from the user, and first 23 and second 23' straps enveloping the first 31' and second 31 shoulders of the user, respectfully, such that the arms 30 of the user are situated over the straps. FIGS. 14A, 14B, and 14C illustrate a third alternative embodiment 36 of the invention, wherein the body 37 is shorter and wider, with a shorter and wider bag mouth 38.

In summary, as shown in FIG. 15, an exemplary method of the present invention comprises the steps of:

a. extruding a tube of thin film plastic having a length;

b. flattening said tube;

c. forming in said length of tube a thermoplastic bag having front and rear walls having upper and lower ends, said lower ends sealed to one another such that front and rear walls form a body configured to carry goods between said front and rear walls, said bag further having first and second edges and upper and lower ends, a bag mouth having first and second opposing ends and a medial area therebetween, and first and second straps emanating from said first and second opposing ends of said bag mouth, respectively, each of said straps having a free end distal said bag mouth, d. securing said free end of each of said first and second to said rear end of said bag wall so as to form a backpack.

Figure 16A:
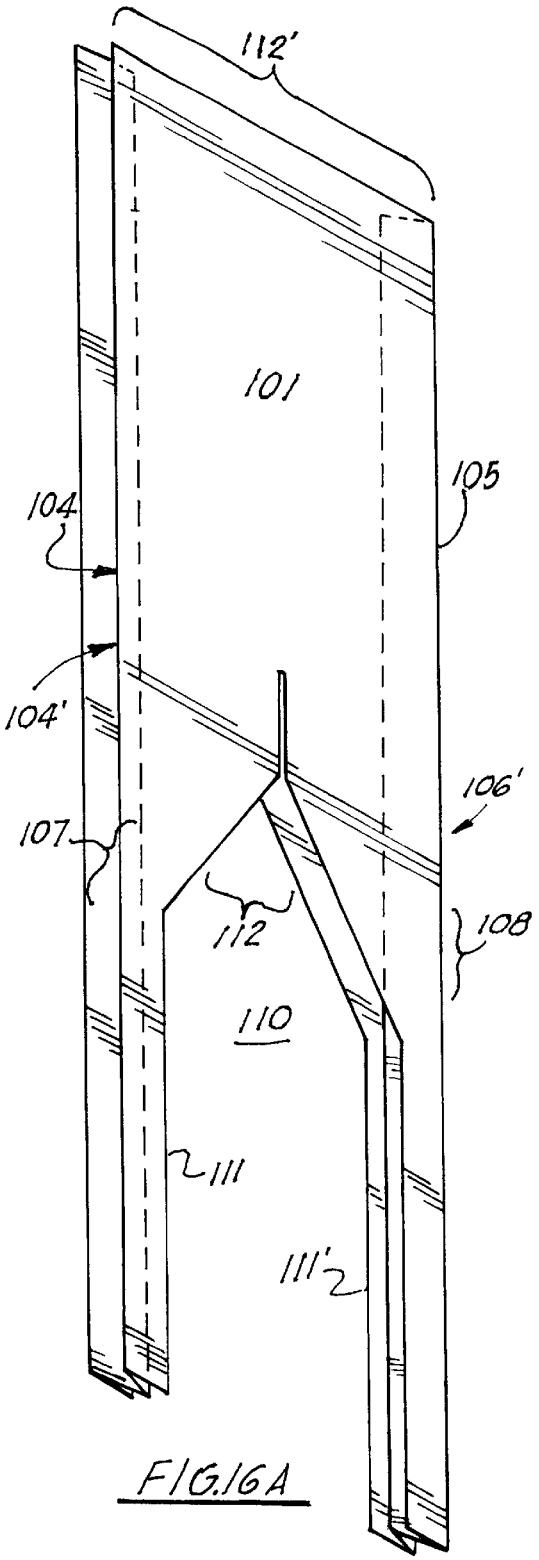
FIG. 16A is an isometric view of a second alternative embodiment of the present invention, illustrating a gussetted tube cut-out utilized to form the pack.
Figure 16B:
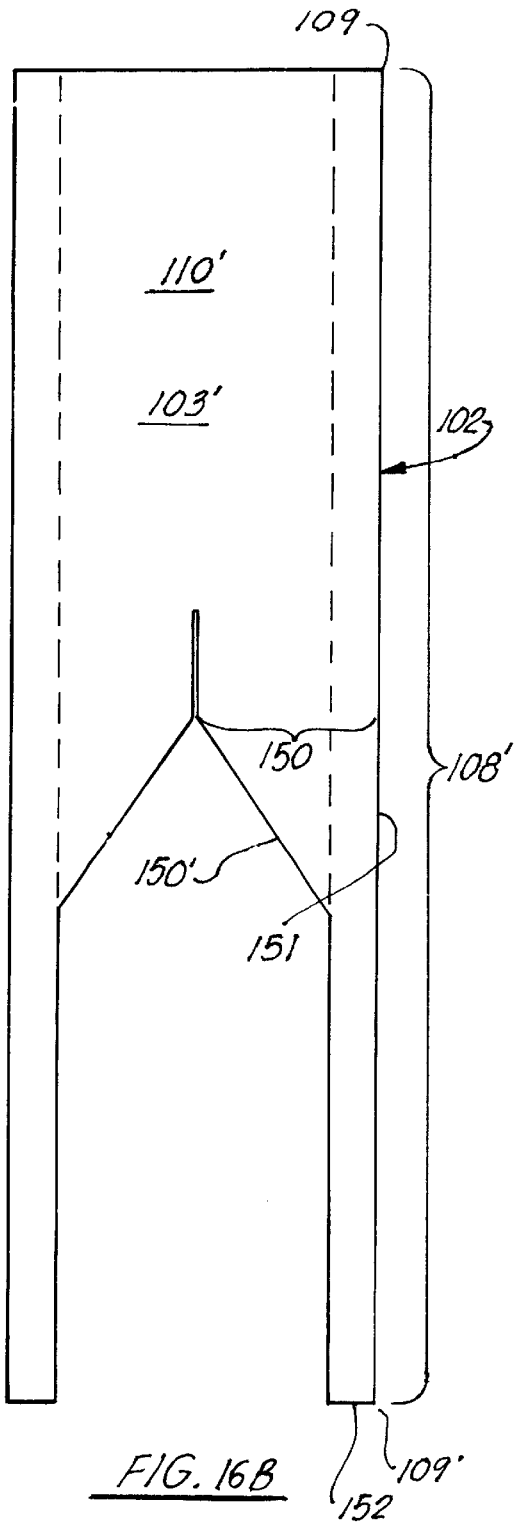
FIG. 16B is a side view of the second alternative embodiment of FIG. 16A.
Figure 16C:
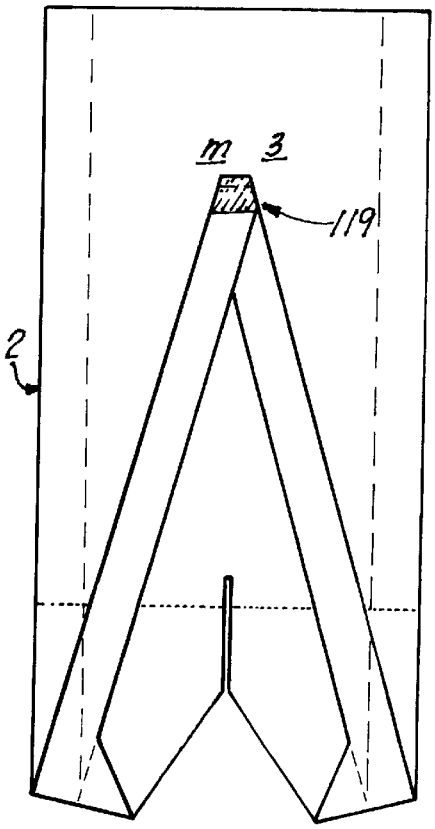
FIG. 16C is a side view of second alternative embodiment of FIG. 16A, illustrating the handles in folded and secured position to form shoulder straps.
Figure 16D:
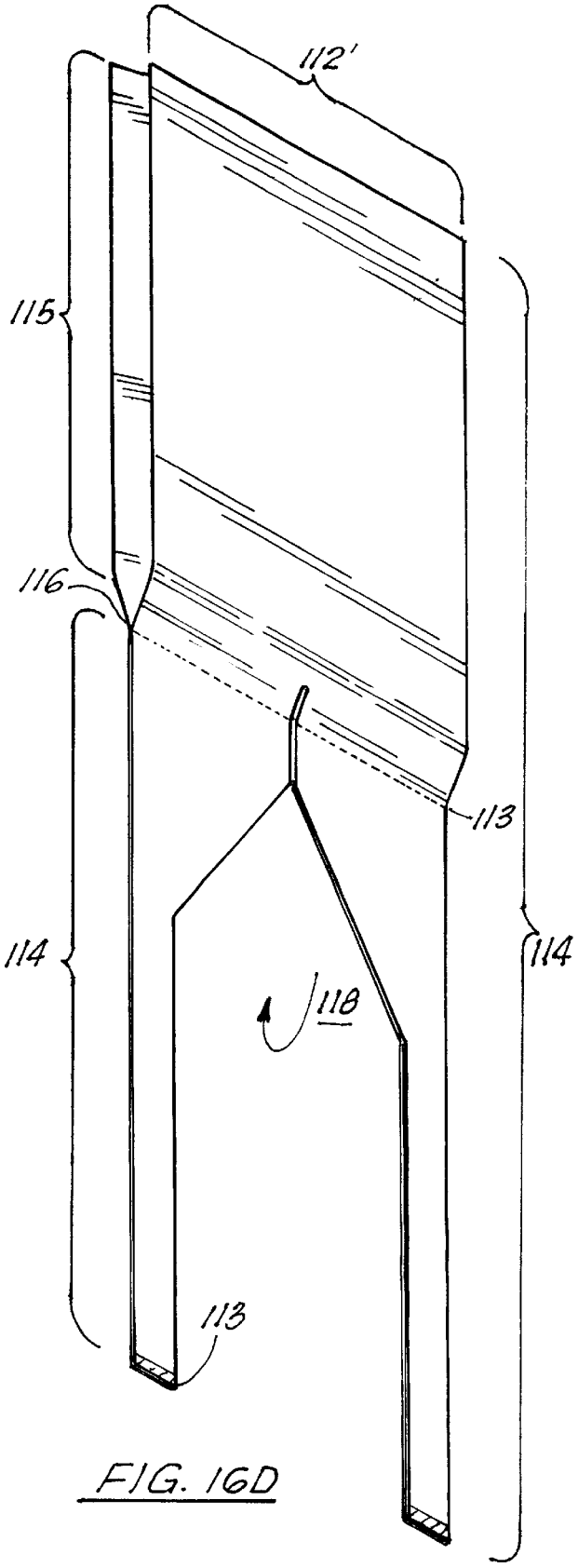
FIG. 16D is an isometric view of the second alternative embodiment of FIG. 16C, prior to folding and securing the handles into shoulder straps.
Figure 17A:
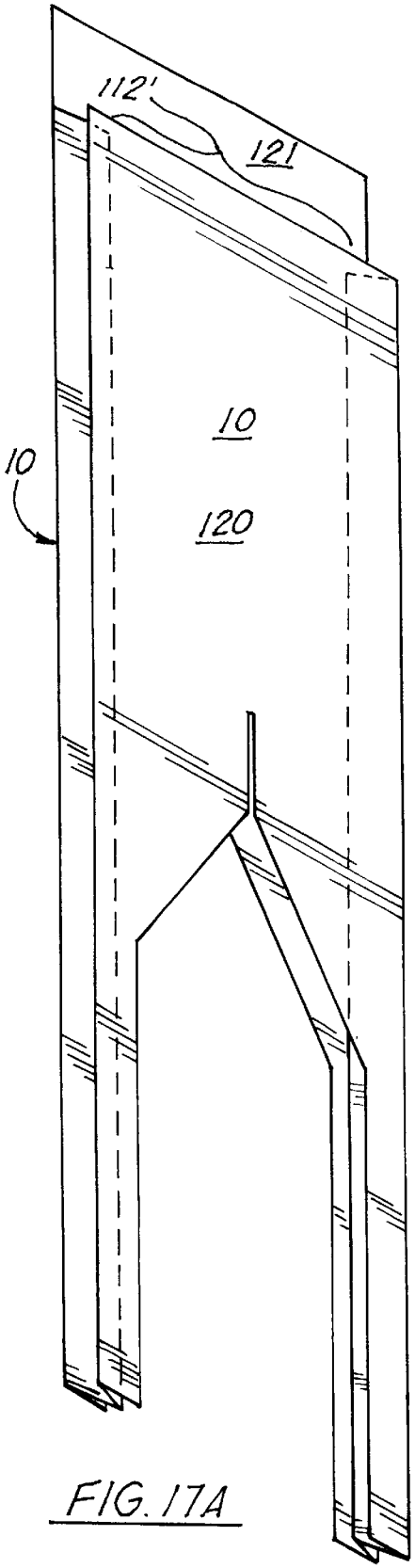
FIG. 17A is an isometric view of the preferred embodiment of the present invention, illustrating the invention of FIG. 16C in the form of a gussetted tube cut-out utilized to form the pack, with the addition of a flap.
Figure 17B:
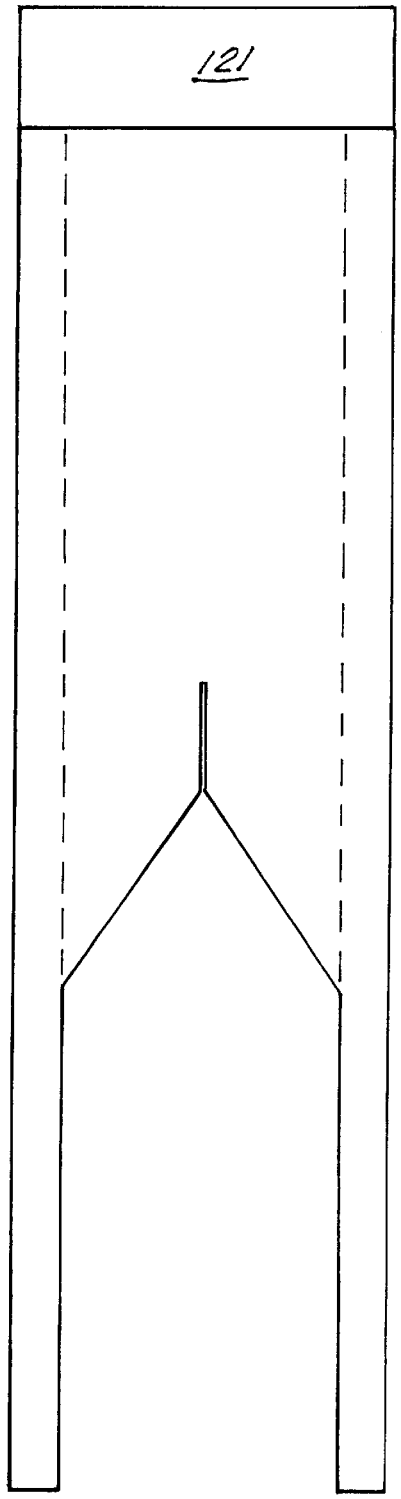
FIG. 17B is a side vie of the invention of FIG. 17A.
Figure 17D:
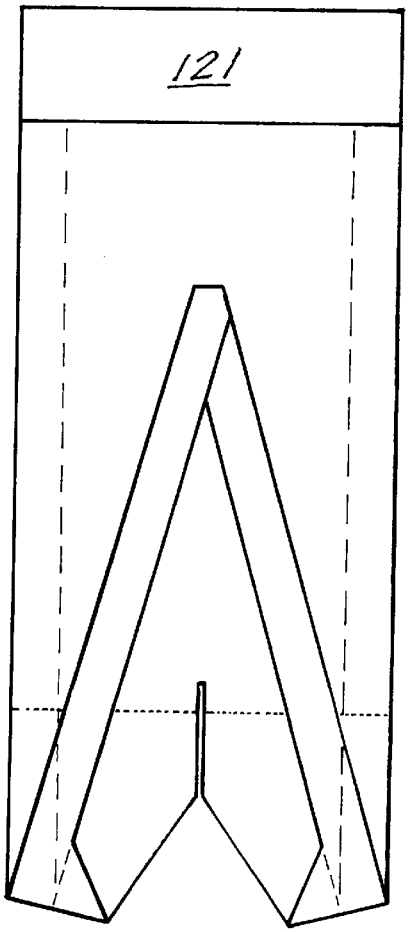
FIG. 17D is a side view of the invention of FIG. 17A, wherein the handles have been folded up and the ends secured to the back wall of the cut-out, the cut-out situated to provide a flap which may be folded over to cover the mouth opening and containment area.
Figure 17C:
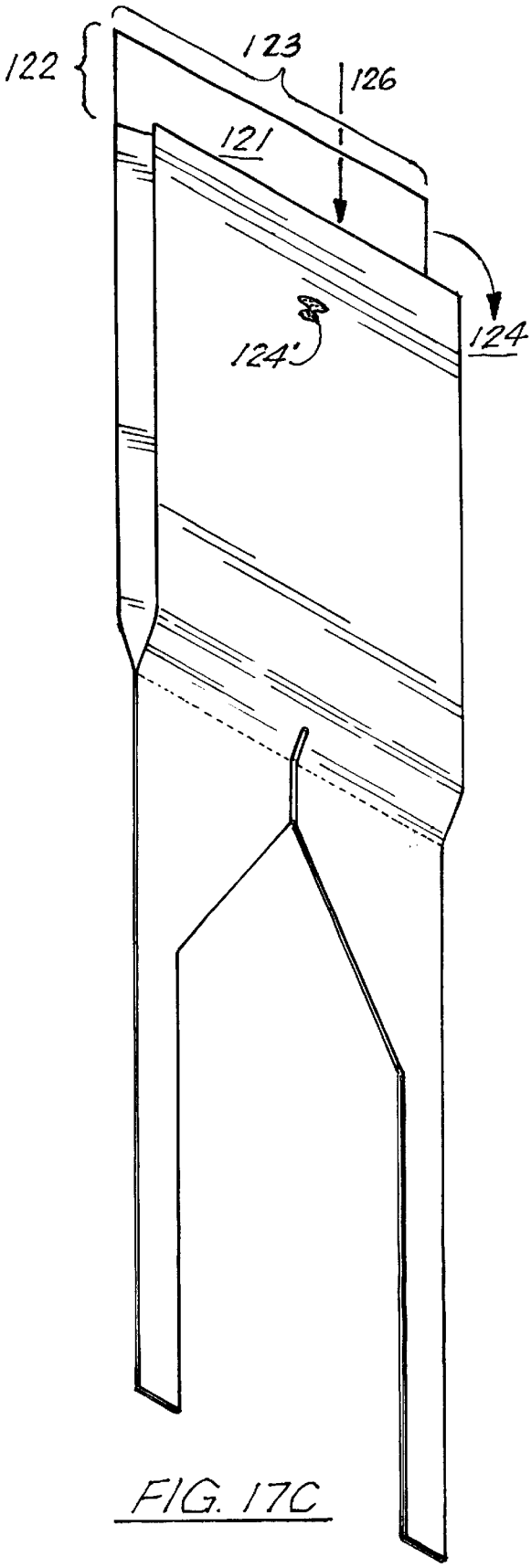
FIG. 17C is an isometric view of the invention of FIG. 17, with the cut-out further welded to form a mouth opening and a containment area.

A second, new alternative to the present invention may be found in FIGS. 16A–16D of the drawings, FIGS. 16A–16B illustrating a flattened film tube 101 of high density polyethelyne (HDPE), low density polyethylene (LDPE), co-axially extruded HDPE/LDPE, linear low density polyethylene (LLDP) or the like is provided having a front face 102, a rear face 103, formed of first and second walls, respectively, and first 104 and second 105 edges. In the preferred embodiment of the invention, first 107 and second 108 gussets are formed by folding over and applying pressure 104', 106' to edges 104, 105 respectively.

Continuing with the figures, a length 108' of the aforementioned tube is cut, and a handle cut 110 area is formed, removing a portion of the front and rear faces of the tube, forming a bag having first 109 and second 109' ends, first 111 and second 111' straps, and a base 112 therebetween, with a bag mouth 112' situated at the opposing, first 109 end, the bag mouth configured to receive and convey goods in the body of the bag such as groceries, clothes, goods, etc.

Continuing with FIGS. 16A–16D, the respective walls of the bag are then laterally welded along a line 113', extending laterally along the base of the handles or straps 111, 111', so as to weld 113', seal, or otherwise adhere the base such that the respective layers of bag walls provided therein are joined, separating the flattened tube cut out into a length forming a container 115 having an open mouth 112', and a length 114 forming handles or straps, divided by the weld 113' at the base 116 of the handles 111, 111'. Each of said first and second handles has a first end 151 and second ends 152, the first end emanating from the lower end of the container 115, the first end 151 preferably having a taper 150' toward the medial portion of the container such that the first end of the first and second straps are somewhat wider than the second end of the straps, so as to provide enhanced support of the container at the base.

Figure 18B:
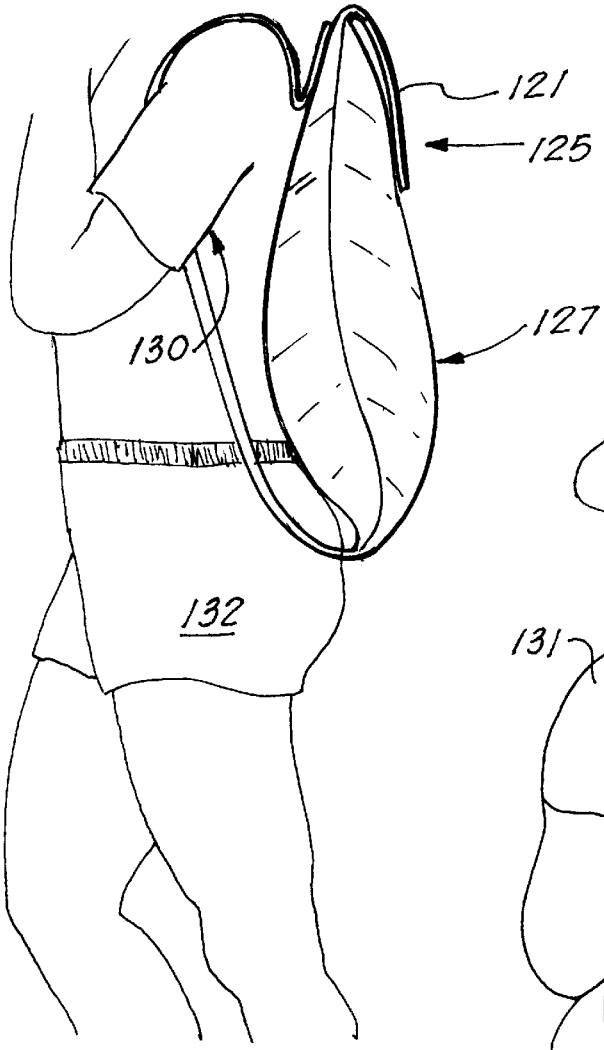
FIG. 18B is an edge view of the invention of FIG. 18A, illustrating the straps situated about the shoulders of the user, such that the containment area is supported in a back pack fashion.
Figure 18A:
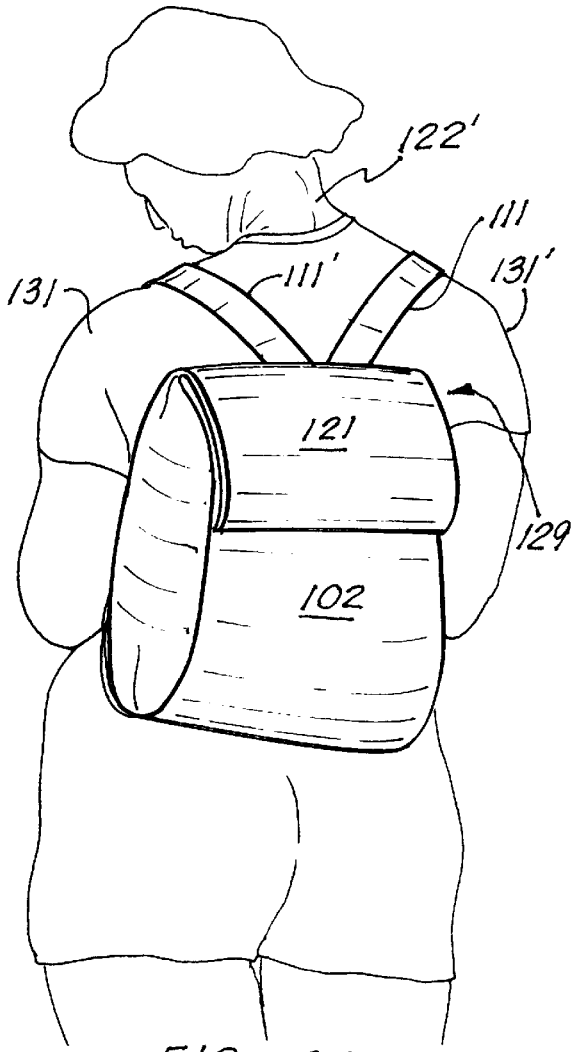
FIG. 18A is a rear view of the invention of FIG. 17D, illustrating the flap folded over the opening, so as to secure and protect the contents within the containment area.

The handles 111, 111' are then folded 118 at about the welded 113' base at about the base of the handles, such that the distal end 113 of the handles engage one of the rear wall 101 of the back pack near the upper, medial area M of the unit, and joined or welded 119 thereto, so as to form a backpack which may be worn by a user in the manner illustrated in FIGS. 18A–18B, as will be further discussed infra.

FIGS. 17A–17D illustrate the third, preferred embodiment of the present invention, which comprises the invention of FIGS. 16A–16D, with the inclusion of a flap 121 emanating from the front face 102 of the flattened, gusseted tube 120 forming the cut-out, the flap 121 having a length 122 of about ⅓ its width 123, its width being about that of the front face 102, the flap configured to fold 124 over the open bag mouth 112' so as to cover same, thereby protecting and securing any contents placed within the bag mouth. A releasable contact adhesive 124' may be provided medially upon the upper rear face 103 of the unit to releaseably secure the flap so as to cover and secure the bag mouth 112'.

Continuing with FIGS. 18A–18B, the invention of FIGS. 16A–16D and 17A–17D are configured such that first 111 and second 111' straps encircle the first 131 and second 131' shoulders of a user, and the straps are situated under the arms 130 of the user 132. The body of the unit then rests comfortably against the back of the user, with the backpack opening or mouth 112' resting adjacent to the base of the neck 122 of the user.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. The method of forming a lightweight receptacle for conveying items along the back and first and second shoulders of a user, comprising the steps of:

a. extruding a tube of thin film plastic having a length;

b. flattening said tube;

c. forming in said length of tube a thermoplastic bag having front and rear walls having upper and lower ends, said lower ends sealed to one another such that said front and rear walls form a compartment configured to carry goods between said front and rear walls, said compartment further having first and second edges and a lower end between said upper and lower ends of said bag, further forming in said length of tube at said upper end a bag mouth having first and second opposing ends and a medial area therebetween, and further forming in said length of tube first and second straps having first and second ends, said first ends of said first and second straps emanating from said lower end of said compartment;

d. folding over said first and second straps such that said second ends of said first and second straps are brought into the vicinity of said rear wall of said bag, and securing said second end of each of said first and second straps to said rear wall of said bag so as to form a backpack.

2. The method of claim 1, wherein after step "c" there is further provided the step of forming said front wall of said bag such that said front wall extends beyond said rear wall at said upper end of said front and rear walls so as to form a flap which can be folded over said bag mouth and secured about said upper end of said rear wall.

3. The method of claim 2, wherein there is further provided after step "c" the additional step of forming a taper at said first end of said first and second straps, said taper providing a wider first end than said second end of said first and second straps, respectively.

* * * * *